US007159431B2

(12) United States Patent
Hartung et al.

(10) Patent No.: US 7,159,431 B2
(45) Date of Patent: Jan. 9, 2007

(54) METHOD OF OPERATING A SECTION STRAIGHTENING MACHINE

(75) Inventors: Hans Georg Hartung, Pulheim (DE); Werner Kohlstedde, Hilden (DE); Markus Willems, Erkrath (DE); Hans-Jürgen Reismann, Düsseldorf (DE); Manfred Riffelmann, Moers (DE); Ulrich Svejkovsky, Wuppertal (DE); Stefan Ernst, Duisburg (DE)

(73) Assignee: SMS Demag Aktiengesellschaft, Dusseldorf (DE)

( * ) Notice: Subject to any disclaimer, the term of this patent is extended or adjusted under 35 U.S.C. 154(b) by 79 days.

(21) Appl. No.: 10/974,596

(22) Filed: Oct. 27, 2004

(65) Prior Publication Data

US 2005/0056068 A1 Mar. 17, 2005

Related U.S. Application Data

(62) Division of application No. 10/312,101, filed as application No. PCT/EP01/06319 on Jun. 2, 2001, now Pat. No. 6,843,091.

(30) Foreign Application Priority Data

Jun. 21, 2000 (DE) ..... 100 29 387

(51) Int. Cl.
*B21D 3/02* (2006.01)

(52) U.S. Cl. ..... 72/164

(58) Field of Classification Search ..... 72/164, 72/160, 165, 248
See application file for complete search history.

(56) References Cited

U.S. PATENT DOCUMENTS

| | | | | |
|---|---|---|---|---|
| 1,516,627 | A * | 11/1924 | Wise | 72/164 |
| 1,645,637 | A * | 10/1927 | Wise | 72/164 |
| 3,765,210 | A * | 10/1973 | Lemper | 72/164 |
| 4,022,046 | A * | 5/1977 | Serizawa et al. | 72/161 |
| 4,222,256 | A * | 9/1980 | Johnson | 72/164 |
| 5,758,533 | A * | 6/1998 | Quehen et al. | 72/163 |
| 6,266,989 | B1 * | 7/2001 | Pohl et al. | 72/245 |
| 6,354,127 | B1 * | 3/2002 | Rossini | 72/164 |

* cited by examiner

*Primary Examiner*—Daniel C. Crane
(74) *Attorney, Agent, or Firm*—Andrew Wilford

(57) ABSTRACT

A section straightening machine is operated by a method which involves passing the structural sections through the array of straightening tools. Section straightening forces are applied to adjustable shafts carrying the tools and adjusters at the service sides of the shaft applying forces acting counter to the section straightening forces.

4 Claims, 5 Drawing Sheets

METHOD OF OPERATING A SECTION STRAIGHTENING MACHINE

CROSS REFERENCE TO RELATED APPLICATIONS

This application is a division of Ser. No. 10/312,101 filed 20 Mar. 2003 (now U.S. patent Ser. No. 6,843,091 issued 18 Jan. 2005) which was a national stage of PCT/EP01/06319 filed 2 Jun. 2001 and based upon German national application 100 29 387.5 of 21 Jun. 2000 under the International Convention.

FIELD OF THE INVENTION

Our present invention relates to a method of operating a straightening machine for straightening sections, i.e. structural shapes or profiles, like rolled beams or similar steel sections, which has tools arranged on driven straightening shafts, a plurality of which are mutually parallel to one another above and below the alignment line in the transport direction of the product to be straightened and of which preferably the upper straightening shafts are adjustable for setting the straightening gap.

BACKGROUND OF THE INVENTION

The need to cure multiaxial deviations from the desired section shape arises from the passage of the sections, for example H-beams, U-beams or T-beams, after the rolling onto a cooling bed. There they remain for cooling until they generally reach a temperature of about 60° C. In the preceding rolling process and especially however also during the cooling down, the sections distort both vertically and horizontally and also can twist about their longitudinal axes. As a consequence, apart from geometric nonuniformity in the rolled products, intrinsic stresses can arise in the material which are more clearly indicated in a subdivision of the section.

Through the use of section straightening machines, especially those which have been customary for thick wall sections, a biaxial planar arrangement of straightening rollers or tools above and below the alignment line engage the product to be straightened and are arranged in the transport direction to subject the product to an alternating bending. Tools are comprised as a rule of straightening disks fastened on bushings which are arranged on straightening shafts with the same axes as the tools and with a predetermined pitch or spacing or at a predetermined distance from one another. The alternating bending can result ideally in an improvement of the straightening, in both the vertical and horizontal directions. In this connection, it is known for the straightening of, for example H-beams (see EP D1 0 472 765), to provide at least one of the beam flanges with a straightening disk which is axially adjustable and engages that flange from the inside and is carried by a straightening shaft and in this manner enables variation of the outer dimension or chamber dimension of the flange by the straightening disk.

Since the straightening results for bar material, sections or like rolled beams depend significantly upon the stiffness of the overall straightening machine, the known section straightening machines are comprised of a multipart stand of welded construction or a stand of a combined cast construction and welded construction. The straightening machines which are of purely welded construction are usually so formed that two lateral stands are connected by means of a lower traverse and an upper traverse with one another. In configurations as a cast construction/welded construction, two massive cast beams are connected together by welding.

In a section-straightening machine which has become known from DE 28 23 526 C2, the two lateral stands are arranged at a distance one behind the other in the travel direction of the bar material, these lateral stands being formed by upright stand beams which are mounted in a portal-like manner at the ends of the horizontal stand beam while C-shanks interconnect intermediate posts together at their ends by tension lugs. The basis for this massive construction is to enable it to take up the straightening forces in a closed system. The requirements for straightening precision with this configuration necessitates stiff and massive stand constructions which are material-intensive and thus costly components. The mechanical machining of such components in turn requires that large, expensive and not readily available machine tools be used.

OBJECTS OF THE INVENTION

The invention has as its object to provide a section straightening machine of the type described at the outset which, in spite of a simple light-weight construction, is capable independently of the different straightening forces which occur for the various sections to reduce the spreading and/or straightening gap widening and in general to reduce the loading and especially the bearing loading which is applied to the machine.

SUMMARY OF THE INVENTION

These objects are achieved in accordance with the invention in that the straightening shafts are individually adjustable and in that each is provided with adjustment means which engages at both sides of the straightening shaft whereby in a straightening operation the adjusting means which is remote from the drive side and is located at the service side has applied thereto a force which is counter to the straightening forces. The adjusting means preferably acts upon the shaft from below and preferably individually on the upper straightening shafts. Thus the straightening forces can be taken up over short stretches between the bearing mounting pieces or units of the upper and the lower straightening shafts because force-transmission means can be provided which conduct the forces from one bearing mounting piece to another bearing mounting piece or from one bearing unit to another bearing unit. A closed frame can then be completely eliminated and the machine weight significantly reduced thereby. Since the straightening forces no longer need to be taken up by a closed frame construction which must have a sufficiently high stiffness for this purpose, the so to speak frameless section straightening machine based upon the features of the invention also can be free from frame widening. The known section-straightening machines with a closed frame construction have, in spite of their high stiffness, a spring constant for each stand that is detrimental for the straightening process since the stand deforms under load.

According to an advantageous configuration of the invention, hydraulic cylinders are employed as the adjusting means for the vertical adjustment of the upper straightening shaft or the tool carried thereby. This opens up the possibility that the section to be straightened can run into the machine in a slightly open state of the tools and during the straightening process, an adjustment of the straightening shafts can be undertaken even under load. According to an alternative, electromechanically actuated spindles are used as the adjusting setting means. The adjustment is thus effected in a conventional manner by means of worm gear transmissions whereby, however, no adjustment under load can be carried out.

In accordance with the invention, the driven side adjustment means is loaded in compression and the tool-side or service-side adjusting means is loaded in compression in the take up of the straightening forces which arise in a construction of a section-straightening machine having straightening shafts which in the usual manner are cantilever journaled. In the case in which adjusting spindles are provided, the tooth flanks are correspondingly loaded in opposition. Where however hydraulic cylinders are advantageously used, it is proposed to make the hydraulic cylinder on the tool side larger than the hydraulic cylinder on the drive side. In this way greater or smaller forces can be applied by selection of different lever ratios.

In another embodiment of the stand-less section straightening machine, that is a section straightening machine without a closed frame construction, the tool is disposed between the adjusting means on the straightening shaft. While with a conventional cantilever journaling of the straightening shaft, the straightening force arises outside the stand and traverse construction because of the two-sided journaling of the tool-carrying straightening shaft, better bending conditions can be achieved with better conduction of the straightening force to the lower straightening shafts and the base frame receiving the latter. The straightening tools engage, as a consequence, at distances which are much less outwardly from one another and the usual high component of shaft bending of a cantilever journaling is eliminated so that the settings are maintained without detriment to the straightening results. Exactly because of the two-sided tool journaling, the straightening axis bearings can be smaller than with a cantilever journaling and allow the mean straightening region to be set with equal size hydraulic cylinders.

An advantageous configuration of the invention with two-sided journaling of the tool, provides that the straightening shafts are configured as bipartite and the tool is constructed with a sandwich configuration whereby the drive-side straightening shaft part is tensioned with the service-side straightening shaft part against the sandwich tool by means of a tension anchor. This permits a compact unit to be achieved for the straightening shaft including the tool and in which a bushing can be provided between the drive-side and the service-side straightening shaft parts to receive the tool or straightening disk. As a reliable connection of these components, a highly tensioned tested sandwich connection serves which can transfer the drive torque and can take up the binding forces which are to be expected.

According to a highly advantageous proposal in this configuration of the invention, adjusting means for the bearing mounting piece of the service side straightening shaft part is disposed on a linearly movable base frame which simultaneously also has the bearing unit of the service side lower straightening shaft part. The two-sided journaling of the tool in accordance with the invention enables, by the shiftability of the base frame, a tool or straightening disk replacement for different sections to be straightened in a shorter time. After a retraction or shifting of the service side base frame, the straightening machine opens and the tools of all of the straightening shafts which are provided are freely accessible.

A proposal of the invention provides that the straightening shaft is juxtaposed with a manipulator equipped with means for simultaneous pickup of all of the tools. This can be a floor vehicle or a crane vehicle whereby a replacement traverse can be configured for example with tongs for gripping the tool. The tong manipulator thus enables short replacement times in the case of section changes.

Finally the invention provides that the drive side straightening shaft end or part with its roller bearing be received in a piston comprised of two parts of a cylinder housing of a hydraulic axial shifting unit. This enables play-free fixing of the axial positions independently from one another of the upper and lower straightening shafts.

BRIEF DESCRIPTION OF THE INVENTION

Further details and advantages of the invention are given in the claims and the following description of embodiments of the invention shown in the drawing. In the drawing:

SPECIFIC DESCRIPTION

Figure 1:
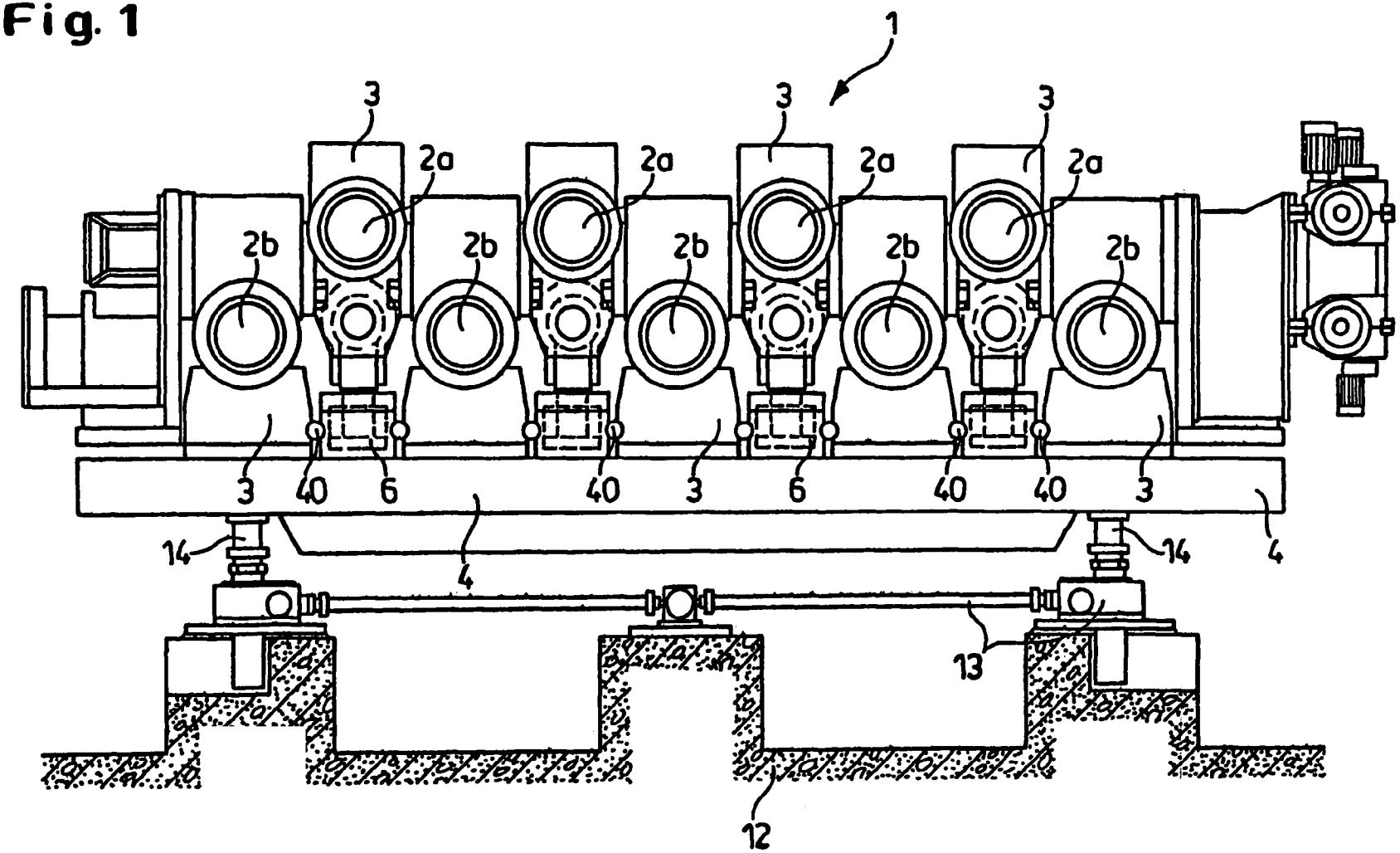
FIG. 1 shows a section straightening machine—in an example as a nine-roller straightening machine—in a front elevational view from the service-side or tool-side.

A section straightening machine 1 has according to FIG. 1, four upper straightening shafts 2*a* and five lower straightening shafts 2*b*. The lower straightening shafts 2*b* are received in bearing mounting pieces 3 which are supported on a bottom beam 4 while the upper straightening shafts 2*a* are arranged in bearing mounting pieces 3 which are carried by cylinder eyes 5 (compare FIGS. 2 and 3) of hydraulic cylinders 6 or 7 supported on the bottom beam 4.

Figure 3:
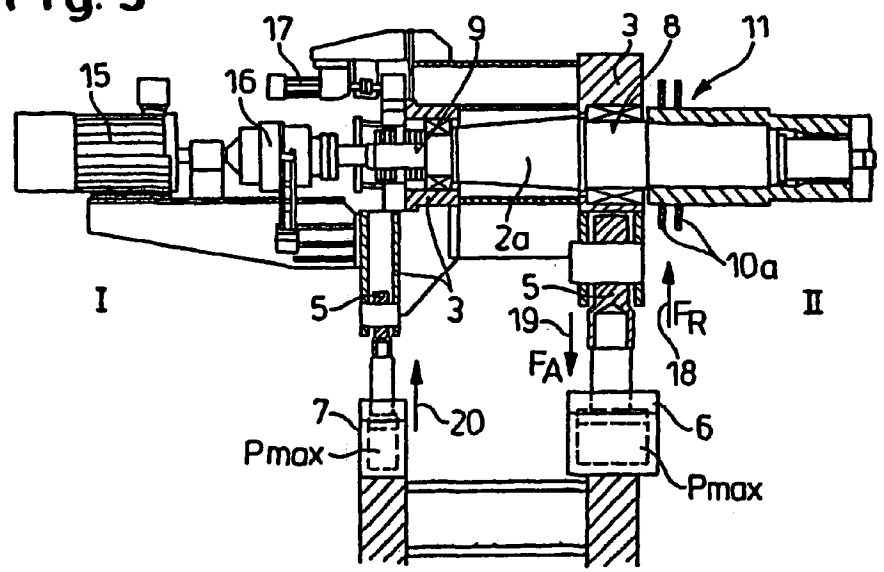
FIG. 3 is a section along line III—III of FIG. 2.
Figure 4:
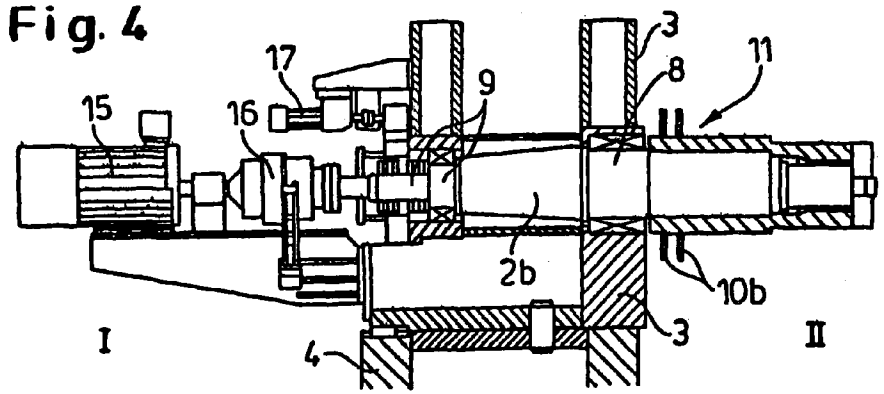
FIG. 4 is a section along the line IV—IV of FIG. 2.

As can be deduced better from FIGS. 3 and 4 the straightening shaft ends 8 or 9 both for the upper as well as for the lower straightening shafts 2*a* or 2*b* are journaled in the bearing mounting units 3 both on the drive side I and on the service or tool side II toward which the straightening shaft ends 8 or 9 are turned. The straightening shafts 2*a* or 2*b* receive upper and lower straightening disks 10*a* or 10*b* to form a tool 11 for straightening, for example a hot rolled H-beam with cantilever journaling. For compensating height differences of different steel shapes, other straightening disk diameters and where at the tools 11, or the upper and lower straightening disks 10*a*, 10*b* in the embodiment—compare FIG. 1—the entire section-straightening machine 1 can be raised and lowered by means of electromechanical adjustment device or lifting device 13 anchored to the foundation 12 via spindles 14 engaged with the bottom beam 4.

Each upper and lower straightening shaft 2*a* or 2*b* is individually drivable by a motor 15 and an intervening transmission 16 provided at the drive side I. In addition drives 17 are there provided for axial adjustment of the straightening shafts 2*a* or 2*b*. The hydraulic cylinders 6 and 7 enable an individual adjustment of the upper straightening shaft 2*a* in the construction of the section straightening machine shown in FIGS. 1–4 with flying journaling of the tool 11 and thereby take up the different loads including the straightening force FR in the direction of arrow 18 (FIG. 3), indeed so that the service side or tool side hydraulic cylinder 6 is loaded in tension according to the arrow direction 19 and the drive side hydraulic cylinder 7 is loaded in compression according to arrow direction 10. In the tool side hydraulic cylinder 6, a pressure Pmax prevails and thus in each respective cylinder chamber, while in the drive side hydraulic cylinder 7 a pressure Pmax prevails in each lower cylinder chamber (compare FIG. 3). When instead of hydraulic cylinders 6, 7 as the adjusting means, setting spindles are used, the tool flanks are correspondingly oppositely loaded.

Figure 2:
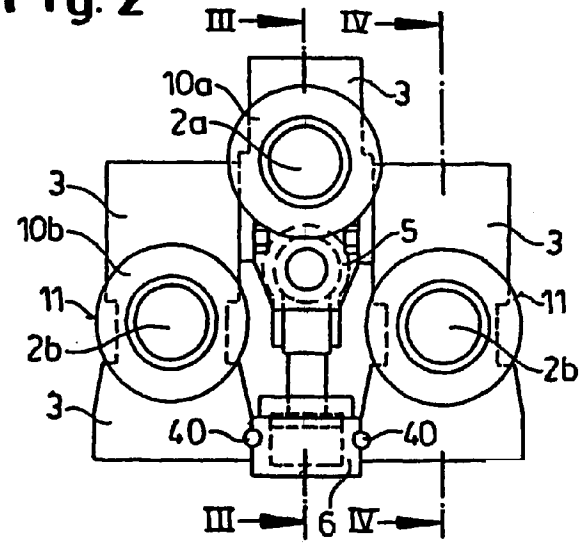
FIG. 2 shows a two-under-shaft and one upper straightening shaft combination with tools forming a detail of FIG. 1.

Because the hydraulic cylinders 6, 7 engage from below the respective upper straightening shaft 2*a* at the straightening shaft end 8 and 9, the straightening forces (arrow 18) are taken up on short paths between the bearing units for which purpose a force-transmitting means 40 (in the example a pin) is provided as the connection between each bearing mounting unit 3 and the neighboring hydraulic cylinder 6 (compare also FIG. 2). The closed frame construction or closed stand required of a conventional section straightening machine can then be eliminated. It suffices to mount the straightening shafts 2*a* or 2*b* only in bearing mounting units 3. The hydraulic cylinders 6, 7 are dimensioned to be of different sizes as can be calculated from the greater or smaller forces which must be supported based upon the different lever ratios and thus the tool side hydraulic cylinder 6 is larger than the drive side hydraulic cylinder 7.

Figure 5:
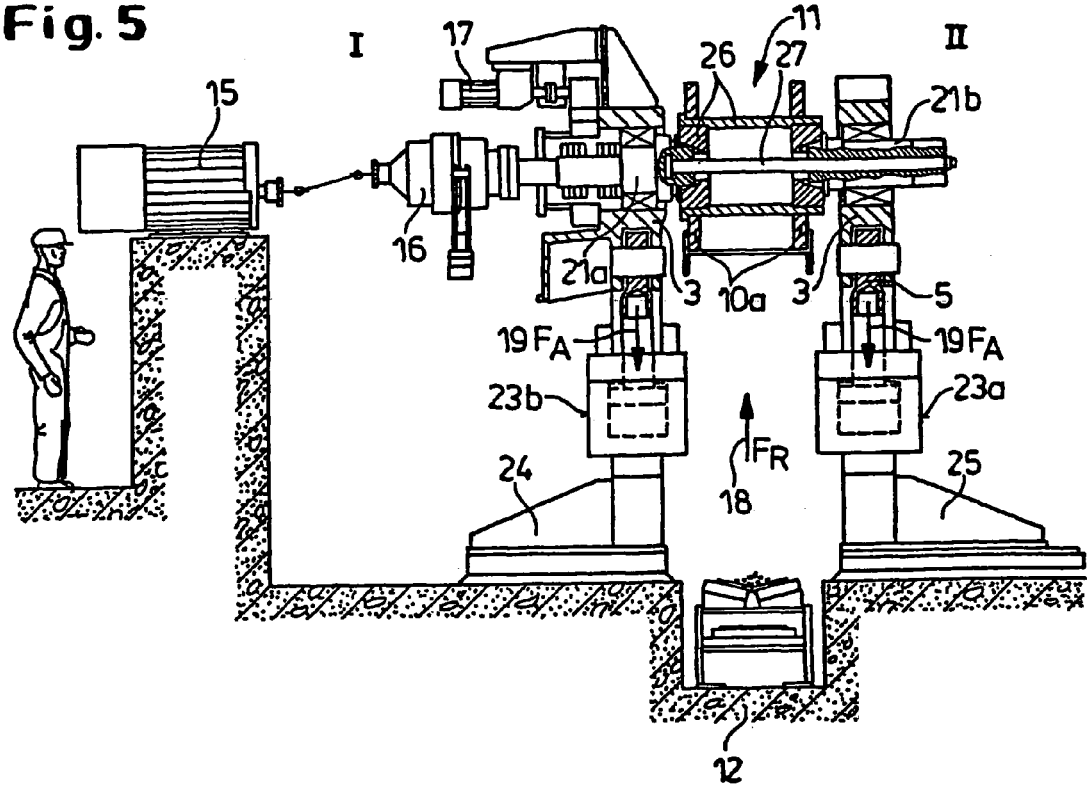
FIG. 5 shows another embodiment of a section straightening machine which has a journaling of the straightening shafts on both sides of the tool is a cross sectional detail through an upper straightening shaft unit comparable with the section of FIG. 3.
Figure 6:
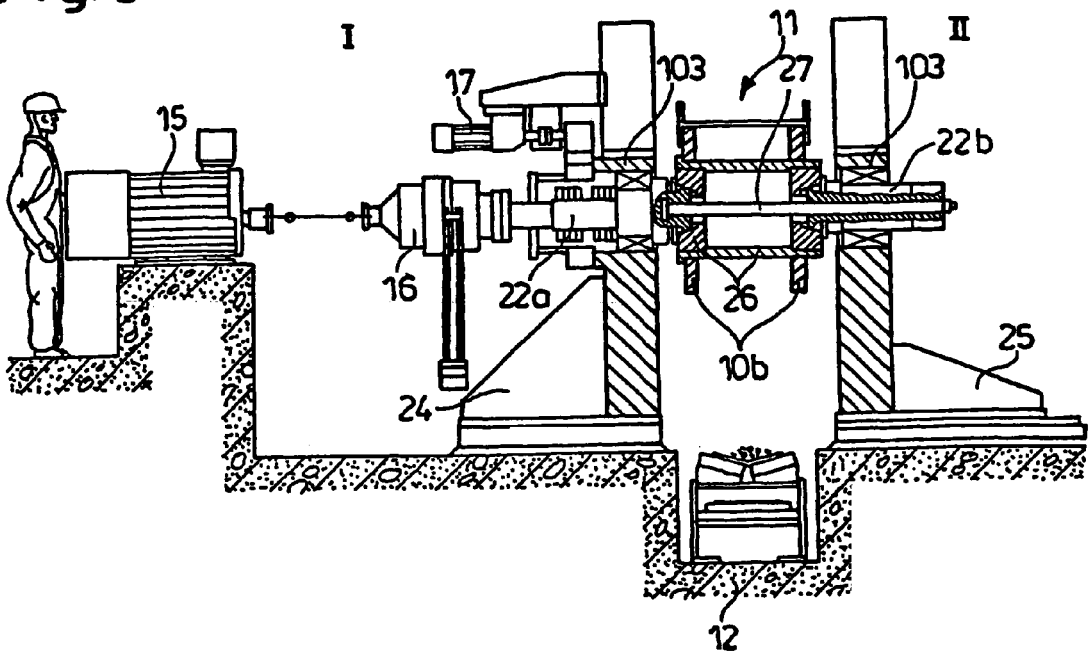
FIG. 6 is a partial detail section of a section straightening machine with journaling of the tools on both sides, taken through a lower straightening shaft unit comparable with the section of FIG. 4.

FIGS. 5 and 6 show details respectively only of the upper straightening shaft and the lower straightening shaft of a section straightening machine of another construction, namely, one which no longer has a cantilever journaling but journaling on both sides of the tool 11. These straightening shafts are comprised here of two straightening shaft parts 21*a*, 21*b* or 22*a*, 22*b* (compare the lower straightening shaft of FIG. 6). Both the upper straightening shaft parts 2*a*, 2*b* and the lower straightening shaft parts 22*a*, 22*b* are—thus far in complete agreement with the aforedescribed embodiment—disposed in bearing mounting units 3 and—the respective lower straightening shaft parts 22*b*—in bearing unit 103 so that also in this case no closed frame construction or closed stand construction is required. The mounting units 3 arranged on both sides of the tool of the upper straightening shaft parts 21*a*, 21*b* are both on the drive side I and on the service side II supported via hydraulic cylinders 23*a*, 23*b* serving as adjusting means which are supported via base frames 24 or 25 on the foundation 12. Also here the straightening force 18—which in this case is applied midway—is taken up over the shortest path and overcoming force transmitting is conducted in a short circuit between the bearings; the bottom beam or the foundation remains free from these forces. The adjustment cylinders or hydraulic cylinders 23*a*, 23*b* are here both subjected to tension FA according to arrows 19. The service side base frame 25 which is equipped with the bearing units 103 for the lower straightening shaft parts 22*a*, 22*b* and the bearing mounting units 3 for the upper straightening shaft parts 21*a*, 21*b* or 22*a*, 22*b* is arranged to be displaceable on the foundation 12, i.e. the service side II of this construction of the section straightening machine remains open so that the tools 11 are freely accessible.

Figure 10:
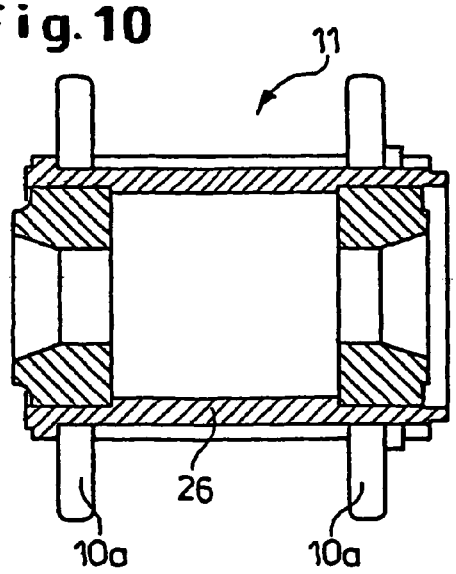
FIG. 10 is a detail in longitudinal section of a multipartite tool.

The double-sided journaling of the tool 11 by means of upper and lower straightening shafts comprised of the two straightening shaft parts 21*a*, 21*b* and 22*a*, 22*b* enables in the interplay with the base frame 25 which is displaceable at the service side, a sandwich construction of the tools 11 which, as a consequence, are also multipartite and can be assembled from a mounting bushing 26 and straightening disks 10*a* and 10*b* carried thereby from above and below. As reliable connections in the upper and lower straightening shaft region of the straightening disks 10*a* or 10*b* (compare also FIG. 10) for the straightening shaft units assembled from the components of the two straightening shaft parts 21*a*, 21*b* or 22*a*, 22*b* and the bushings 26, tension anchors 27 are provided which form a tested highly prestressed sandwich connection.

Figure 9:
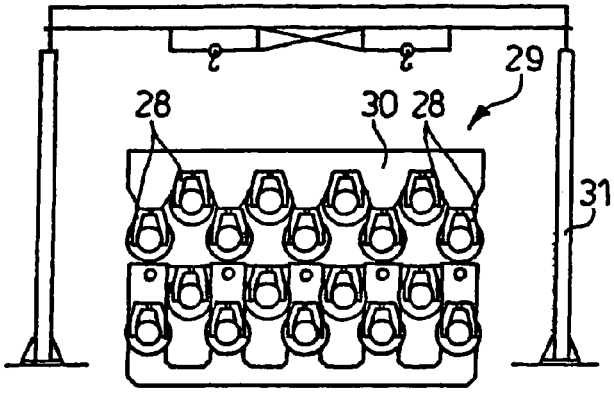
FIG. 9 shows the manipulator unit according to FIG. 8 in an elevated view from the front.
Figure 8:
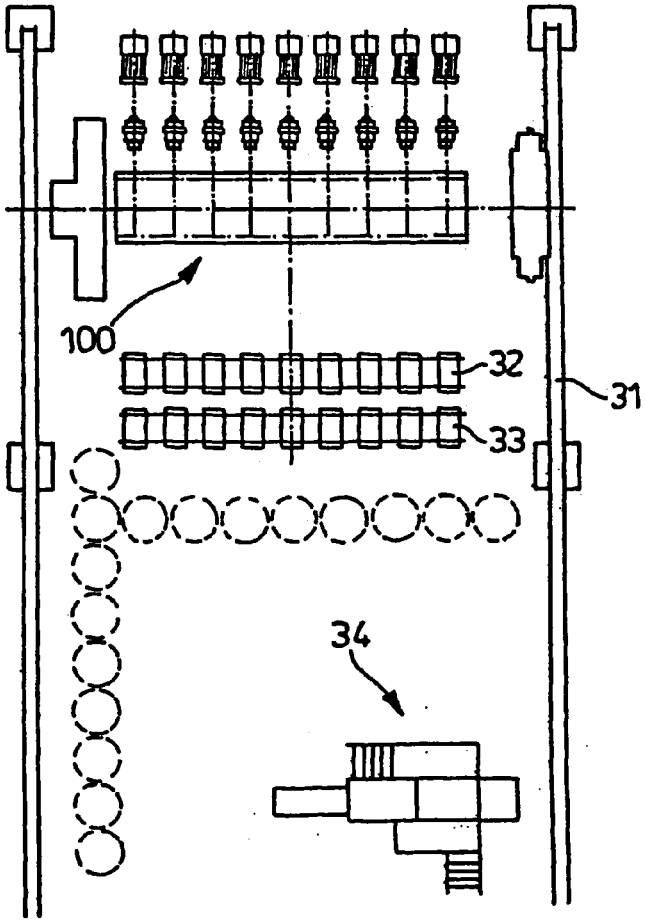
FIG. 8 is a plan view of an embodiment of a manipulator device with simultaneous exchange of all tools in an embodiment of a nine-roller section straightening machine.

The two-sided journaling of the tool 11 in the embodiment of the section straightening machine according to FIGS. 5 and 6 with central force application of the straightening force and thus uniform stress distribution of both bearing mounting units 3 provides in its interaction with the service side displaceable base frame 25 and the sandwich construction of the tool 11 a simplification of the replacement of a worn tool 11 or a replacement as required for another section to be straightened. Thus as shown schematically in FIGS. 8 and 9, a manipulator equipped with jaws 18 for all of the tools 11 provided for the section straightening machine 100 or jaw manipulator 18, in the illustrated embodiment with a traverse 13, which can be displaceable like a kind of crane carriage on the crane track 31 located at an elevated position. A simultaneous and also rapid replacement of all of the tools 11 or bushings 26 requires only release of the prestressing sandwich connection so that thereafter the manipulator can pick up via its jaws 28 all of the bushings 26 or tools 11 simultaneously. Thereafter, the movable base frame 25 is hydraulically displaced, i.e. the service side II of the section straightening machine is opened so that the manipulator 29 can be repositioned and the replacement effected. The bushings 26 with the used straightening disks 10*a* or 10*b* are deposited in position 32 of FIG. 8 and the new tools already located in position 33 are picked up and by displacement of the manipulator 29 or the traverse 30 are brought into their positions in the section straightening machine 100. The movable base frame 25 can then be again displaced and the section straightening machine 100 closed and the sandwich connections tensioned so that the section straightening machine can in short order be again prepared for operation. The operation of the new tools to be substituted can then be effected in an inlet region of the crane track at an erection area 34.

Figure 7:
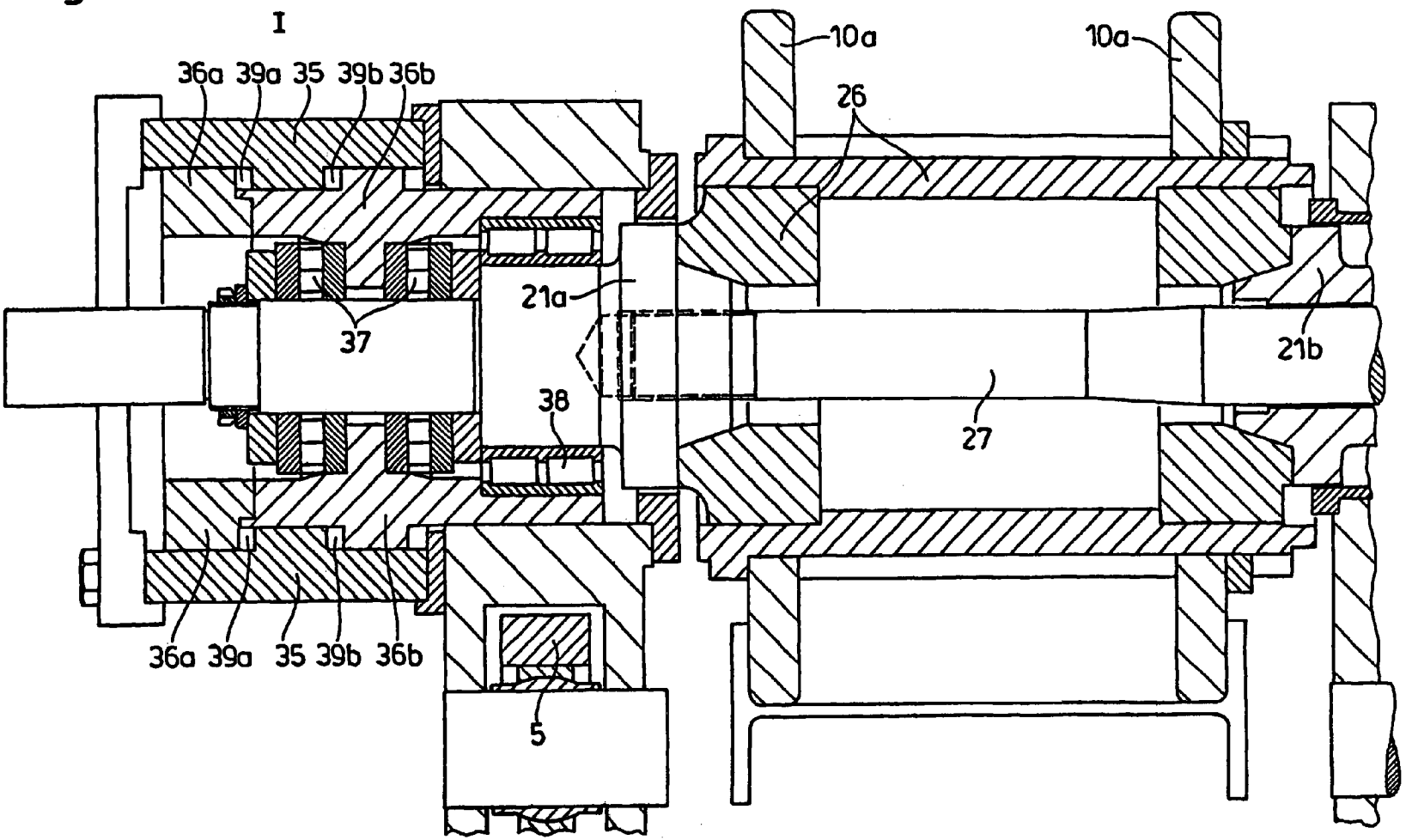
FIG. 7 is a partial longitudinal section as a detail of the straightening machine construction according to FIGS. 5 and 6 in an embodiment of the drive side straightening shaft with a hydraulic axial adjustment.

FIG. 7 shows an example of two part straightening shafts in an alternative configuration for the axial straightening shaft adjustment in the form of a hydraulic unit. A straightening shaft part 21*a* at an outwardly lying end at the drive side I of a cylinder housing 35 is formed which receives a piston comprised of two parts 36*a*, 36*b*, whereby the two piston parts 36*a*, 36*b* simultaneously enclose the roller bearing 37, 38 of the straightening shaft part 21*a*. By pressure application of one or the other of the cylinder chambers 39*a* or 39*b* via controllable hydraulic connections not shown, the straightening shaft part 21*a* can be shifted axially horizontally so that a play-free fixing of the axial position of the straightening shaft can be reached.

Completely identically, however, for any of the constructions of the section straightening machine, that is whether the tools are journaled with a cantilever mounting or two-sided mounting, it is thus possible to provide preferably the upper straightening shafts or the lower with adjusting means (hydraulic cylinders or adjusting spindles) and at least the service side adjusting means with a force application counter to the straightening force which enables the straightening force to be taken up along the shortest path and thereby eliminate the need for a closed frame or closed stand construction of the straightening machine and to obtain the significant advantages described.

We claim:

1. A method of operating a straightening machine for structural sections, the method comprising the steps of:

passing said sections longitudinally through an array of straightening tools on respective mutually parallel straightening shafts disposed above and below a path of the sections and extending transversely to a transport direction of the a sections, at least some of said shafts being adjustable to set a straightening gap, said machine and said shafts having a drive side at which said shafts are driven and a service side opposite said drive side;

supporting each of the adjustable shafts on a respective drive-side adjuster and a respective service-side adjuster offset transversely toward the service side from the respective drive-side adjuster;

individually controlling the drive-side adjusters and service-side adjusters to apply section-straightening forces to said adjustable shafts during a straightening operation; and simultaneously operating the service-side adjusters in tension to apply to the respective shafts forces acting counter to the respective sectioning-straightening forces.

2. The method defined in claim 1 wherein said tools are affixed to cantilevered ends of the adjustable straightening shafts at the respective service sides, and the adjusters at said drive sides of said adjustable straightening shafts are operated in compression while the adjusters at said service sides are operated in tension.

3. The operating method of claim 1 wherein the drive-side adjusters are operated in compression.

4. A method of operating a straightening machine for structural sections, the method comprising the steps of:

passing the sections longitudinally through an array of straightening tools affixed on cantilevered ends of respective mutually parallel straightening shafts disposed above and below a path of the sections and extending transversely to a transport direction of the sections, at least some of the shafts being adjustable to set a straightening gap, the machine and the shafts having a drive side at which the shafts are driven and a service side opposite the drive side and at which the tools are located;

individually controlling adjusters at the drive and service sides of the adjustable straightening shafts, whereby section-straightening forces $F_R$ are applied to the adjustable shafts during a straightening operation; and simultaneously controlling adjusters at the service sides of the adjustable straightening shafts to apply respective forces $F_A$ acting counter to the respective force $F_R$, the adjusters at the drive sides being operated in compression and the adjusters at the service sides being operated in tension.

* * * * *